US007472752B2

(12) United States Patent
Rogers et al.

(10) Patent No.: US 7,472,752 B2
(45) Date of Patent: Jan. 6, 2009

(54) APPARATUS AND METHOD FOR FORMING MULTIPLE PLUGS IN A WELLBORE

(75) Inventors: Henry E. Rogers, Duncan, OK (US); Frank V. Acosta, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 94 days.

(21) Appl. No.: 11/651,333

(22) Filed: Jan. 9, 2007

(65) Prior Publication Data

US 2008/0164029 A1 Jul. 10, 2008

(51) Int. Cl.
*E21B 33/16* (2006.01)

(52) U.S. Cl. ..... 166/289; 166/177.4; 166/318; 166/291

(58) Field of Classification Search ..... 166/289, 166/291, 177.4, 318
See application file for complete search history.

(56) References Cited

U.S. PATENT DOCUMENTS

| | | | | | |
|---|---|---|---|---|---|
| 2,370,833 | A | * | 3/1945 | Baker | 166/153 |
| 2,435,016 | A | * | 1/1948 | Pitts | 166/154 |
| 2,502,886 | A | * | 4/1950 | Ragan | 166/194 |
| 3,051,244 | A | * | 8/1962 | Litchfield | 166/317 |
| 3,237,696 | A | * | 3/1966 | Hall, Sr. | 166/241.6 |
| 3,451,476 | A | * | 6/1969 | Pitts | 166/318 |
| 3,464,493 | A | * | 9/1969 | Chancellor et al. | 166/285 |
| 3,730,267 | A | * | 5/1973 | Scott | 166/335 |
| 3,768,556 | A | * | 10/1973 | Baker | 166/154 |
| 4,105,069 | A | | 8/1978 | Baker | |
| 4,407,365 | A | * | 10/1983 | Cooke, Jr. | 166/249 |
| 4,570,714 | A | | 2/1986 | Turner et al. | |
| 4,671,361 | A | | 6/1987 | Bolin | |
| 5,044,444 | A | | 9/1991 | Coronado | |
| 5,337,829 | A | | 8/1994 | Taylor | |
| 5,348,089 | A | * | 9/1994 | Brandell et al. | 166/154 |
| 5,368,103 | A | | 11/1994 | Heathman et al. | |
| 5,479,986 | A | | 1/1996 | Gano et al. | |
| 5,488,994 | A | | 2/1996 | Laurel et al. | |
| 5,566,757 | A | * | 10/1996 | Carpenter et al. | 166/285 |
| 5,641,021 | A | | 6/1997 | Murray et al. | |
| 5,718,292 | A | | 2/1998 | Heathman et al. | |
| 5,762,139 | A | | 6/1998 | Sullaway et al. | |
| 5,787,982 | A | | 8/1998 | Bakke | |
| 6,053,250 | A | | 4/2000 | Echols | |
| 6,053,262 | A | | 4/2000 | Ferguson et al. | |
| 6,408,946 | B1 | | 6/2002 | Marshall et al. | |
| 6,772,835 | B2 | | 8/2004 | Rogers et al. | |
| 6,880,636 | B2 | | 4/2005 | Rogers et al. | |
| 2004/0040709 | A1 | * | 3/2004 | Rogers et al. | 166/285 |

* cited by examiner

*Primary Examiner*—Hoang Dang
(74) *Attorney, Agent, or Firm*—John W. Wustenberg; Conley Rose, P.C.

(57) ABSTRACT

An apparatus and method for forming plugs in a wellbore, according to which a first volume of slurry is introduced into a work string in a wellbore so that it flows through the work string and discharges before hardening to form a plug. A second volume of slurry is also introduced into the work string so that it flows through the work string and discharges before hardening to form an additional plug.

22 Claims, 3 Drawing Sheets

APPARATUS AND METHOD FOR FORMING MULTIPLE PLUGS IN A WELLBORE

BACKGROUND

This invention pertains to an apparatus and method for forming plugs in a wellbore, such as in oil and gas recovery operations.

It is often necessary to form a plug in a wellbore that penetrates a subterranean earth formation in an oil and gas recovery operation. Such plugs are used for many reasons. For example, the formation surrounding the wellbore, with its fractures, large pores, and other openings, often will be so porous that it absorbs a great deal of any type of fluid that is introduced into the wellbore. To prevent this, a cement slurry is passed from the ground surface, through tubing and into the lower portion of the wellbore where it accumulates to allow some of it to penetrate the formation and fill the fractures, pores and openings. After the cement hardens, some, or all, of the hardened cement remaining in the wellbore is drilled out so that other fluids can be passed through the bore without the absorption problem.

U.S. Pat. No. 6,772,835 discloses a work string including tubing and a downhole tool connected to the tubing for facilitating the introduction of the cement slurry and allowing some of the tubing to be recovered. The tool includes a sacrificial tailpipe portion that can be decoupled from the remaining portion of the tool to allow the latter portion of the tool, as well as the tubing above the tool, to be recovered after the cement plug is formed. The disclosure of this patent is incorporated by reference.

However, there is a certain limit to the amount of slurry a formation can withstand before it collapses. Therefore, in relatively large installations, an initial charge of cement slurry is introduced into the well through the tool described above, with the volume of the charge, and therefore the height of the wellbore that is filled with cement, being less than optimum so as to not damage the formation. Then, the remaining portion of the tool and the tubing above are withdrawn in the manner disclosed in the above patent. After the cement hardens, the process has to be repeated with one or more additional charges of cement slurry until the plug extends to a desired height in the wellbore. This, of course, considerably adds to the cost of the operation.

Therefore, what is needed is a system and method for forming plugs in a wellbore that overcome the above problem.

DETAILED DESCRIPTION

Figure 1:
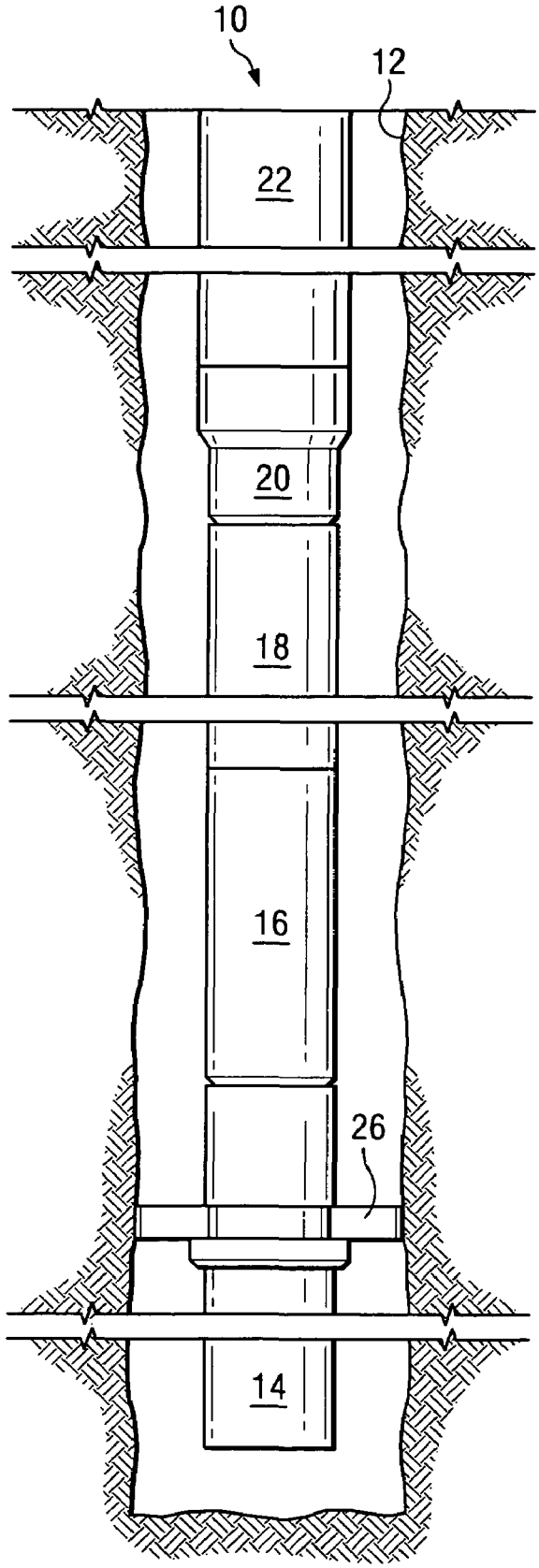
FIG. 1 is a diagrammatic view of a work string according to an embodiment of the invention.

Referring to FIG. 1, a work string shown, in general, by the reference numeral 10 is located in a wellbore 12 and includes a section of tubing 14, which can either be in the form of a series of connected tubular members or a section of coiled tubing. The lower end of the tubing section 14, as viewed in the drawing, is located near the bottom of the wellbore 12, and the upper end portion of the tubing section is threadedly connected to the lower end portion of a tool 16 that will be described in detail below.

The lower end portion of another section of tubing 18, similar to the tubing section 14, is threadedly connected to the upper end portion of the tool 16 in any conventional manner. The lower end portion of another tool 20, which is also described below, is threadedly connected to the upper end portion of the tubing section 18 in any conventional manner. The lower end portion of a third section of tubing 22, similar to the tubing section 14, is threadedly connected to the upper end portion of the tool 20 in any conventional manner, and it is understood that the tubing section 22 extends to the ground surface.

Although not clear from the drawings, it is understood that, in most installations, the lengths of the tubing sections 14, 18, and 22 are far greater than the lengths of the tools 16 and 20; and, when the tubing sections and the tools are connected as shown and described above, the work string 10 thus formed is sufficient to span substantially the entire length of the wellbore 12.

Figure 2:
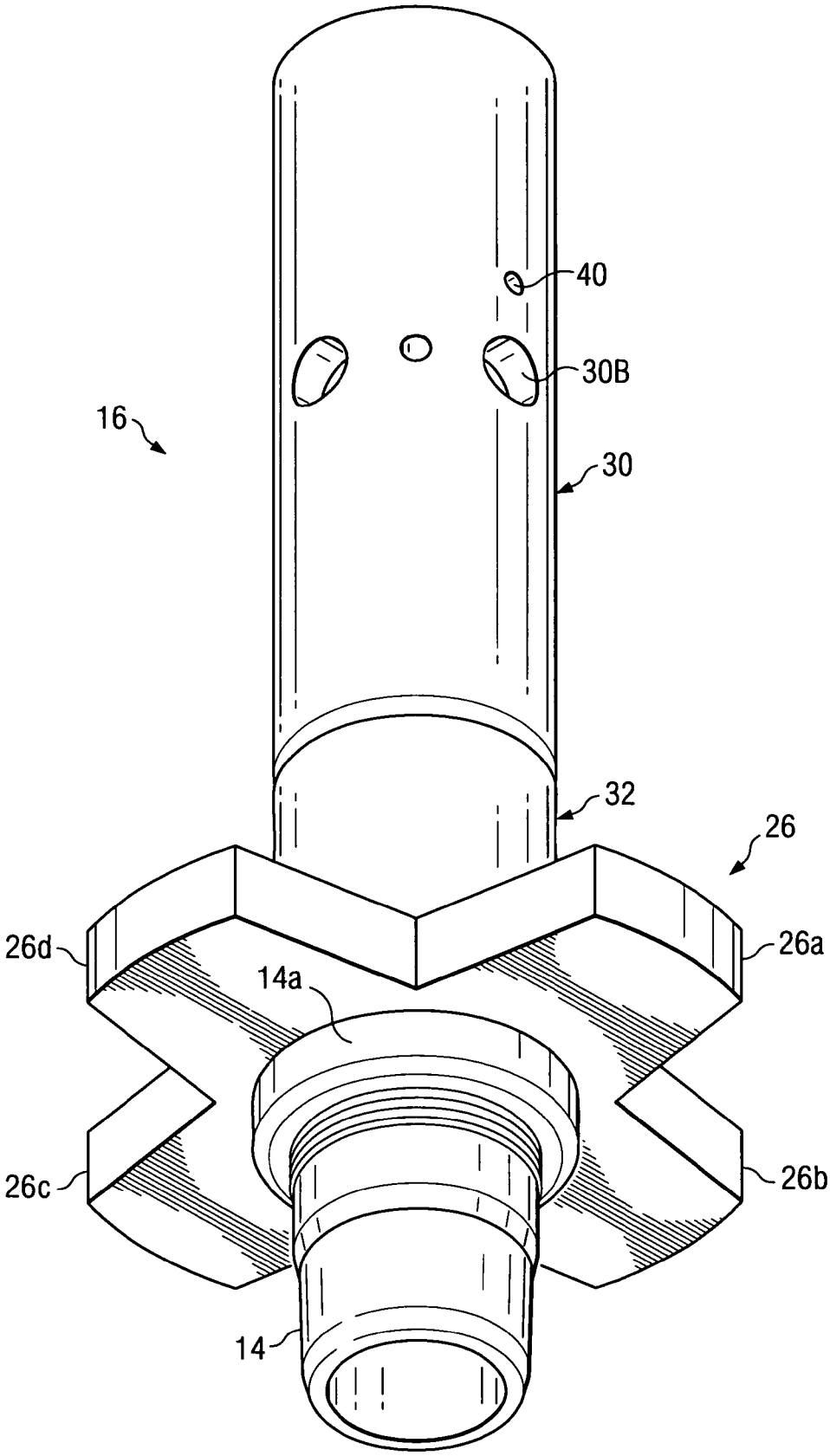
FIG. 2 is an enlarged, isometric view of a portion of the work string of FIG. 1.

A centering device 26 extends around the lower end portion of the tubing section 14 and is shown in detail in FIG. 2. The device 26 is in the form of an annular disc having four angularly spaced cut-out portions to define four angularly-spaced legs 26*a*, 26*b*, 26*c*, and 26*d*. The tubing section 14 has an annular flange located at its lower end portion upon which the device 26 rests, and the radial dimension of each leg 26*a*, 26*b*, 26*c*, and 26*d* is such that each leg extends to the inner wall of the wellbore 12 (FIG. 1). Therefore when lowered into the wellbore 12 as a part of the work string 10, the device 26 functions to center the tool, and therefore the work string 10.

Figure 3A:
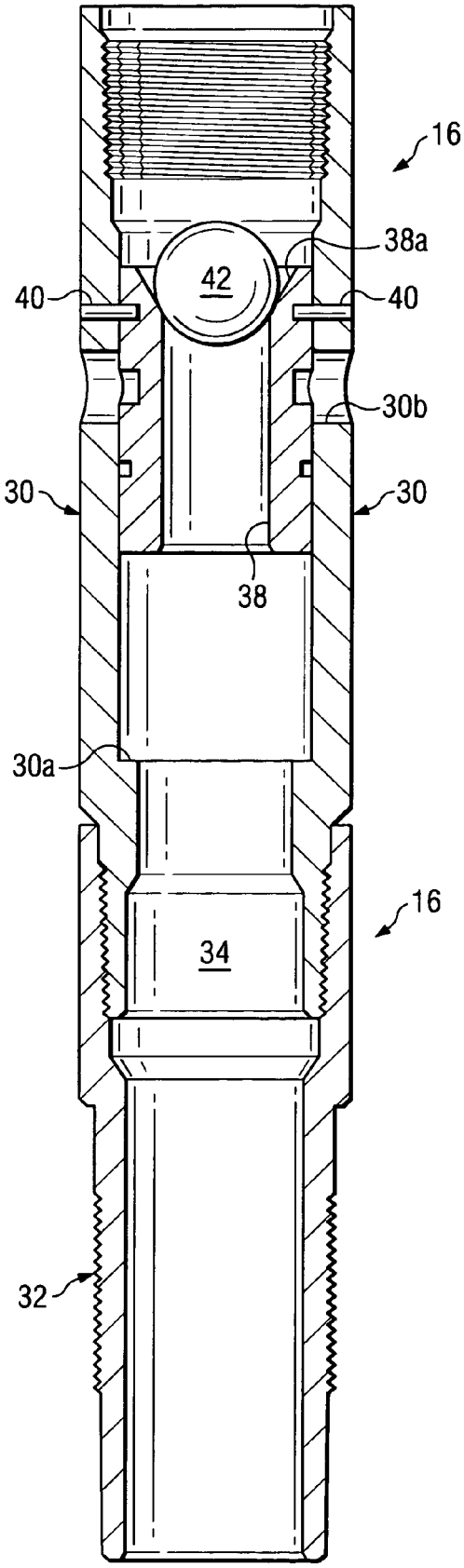
FIGS. 3A and 3B are enlarged, cross sectional views of a tool in the work string of FIG. 1, depicting the tool in different operational positions.
Figure 3B:
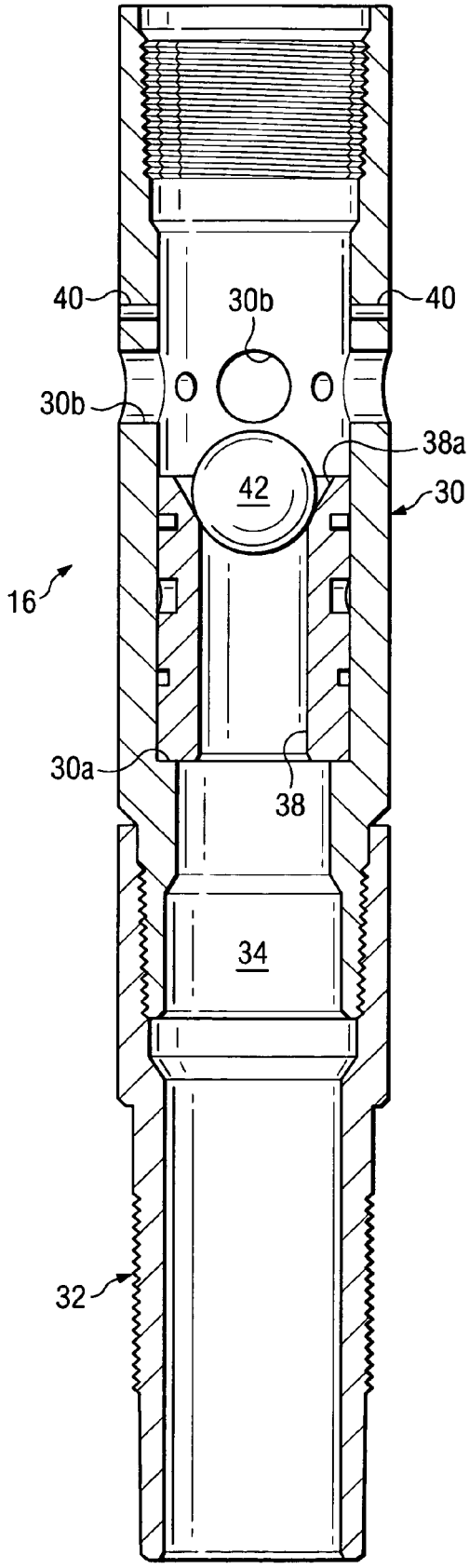

The tool 16 is shown in detail in FIGS. 3A and 3B and consists of an upper tubular member 30 and a lower tubular member 32. The upper end portion of the member 32 telescopes over the lower end portion of the member 30, and the overlapping portions are connected in any conventional manner. A continuous bore 34 is defined by the members 30 and 32 that extend for the length of the tool 16.

The lower end portion of the member 32 is externally threaded for threaded engagement with internal threads formed on the upper end portion of the tubing section 14 (FIG. 1). The upper end portion of the tubular member 30 is internally threaded for threaded engagement with external threads formed on the lower end portion of the tubing section 18 (FIG. 1).

The inner wall of the tubular member 30 is stepped so as to define an internal shoulder 30*a*, and a plurality of angularly spaced ports 30*b* are provided through the wall of the tubular member 30, two of which are shown in FIG. 2.

A sleeve 38 is provided within the member 30 in a coaxial relationship, with the outer diameter of the sleeve being slightly less than the inner diameter of the member 30. The sleeve 38 is adapted for slidable movement in the member 30, and is held in place in its normal position shown in the drawing by a series of angularly spaced shear pins 40, two of which are shown. The shear pins 40 extend through radially extending openings formed through the wall of the tubular member 30 and into corresponding openings in the sleeve 38. The shear pins 40 are adapted to shear at a predetermined axial force applied by the sleeve 38 under conditions to be described.

In the normal, fixed position of the sleeve 38 shown in FIG. 3A, it extends over the ports 30*b*, thus preventing fluid flow through the ports. Once the shear pins 40 have sheared, the sleeve 38 is free to slidably move relative to the member 30 until the lower end of the sleeve abuts the shoulder 30*a* as shown in FIG. 3B. In this position, the ports 30*b* are uncovered.

Although not shown in the drawings, it is understood that one or more axially-spaced O-ring seals can be provided in the interface between the outer wall of the sleeve 38 and the corresponding inner wall of the tubular member 30.

The inner surface of the upper end portion of the sleeve 38 is beveled to form a seat 38*a* for receiving a ball valve 42. Thus, when the ball valve 42 is dropped into the work string 10 from the ground surface, it passes through the work string until it seats on the seat 38*a* and thus blocks the circulation of fluid through the work string. When additional fluid is then introduced into the work string, it pressurizes the work string above the ball valve 42, as viewed in the drawing. When this pressure, and the resulting force on the ball valve, exceeds a predetermined value, the shear pins 40 will shear, allowing the sleeve to slide to the position of FIG. 3B and open the ports 30*b*.

Since the tool 20 is well disclosed in the above-referenced patent, the tool will only be described generally as follows.

The tool 20 contains an upper body member connected to the tubing section 22 and a lower body member connected to the tubing section 18. The two body members are quick-releasably coupled together, and the upper member defines a seat for receiving a ball valve. The latter seat has a greater diameter than the ball valve 42 so as to allow the latter ball valve to pass through the tool 20.

When the ball valve associated with the seat in the upper body member of the tool 20 is dropped into the work string 10 from the ground surface, it passes through the tubing section 22 and seats on the seat, thus blocking the circulation of fluid through the work string. When additional fluid is then introduced into the work string, it pressurizes the work string above the latter ball valve. When the pressure, and the resulting force on the latter ball valve, exceeds a predetermined value, shear pins associated with the upper body member will shear allowing a sleeve to slide. A mechanism is provided that uncouples the upper body member from the lower body member in response to the sliding of the sleeve. Complete details of this tool are provided in the above-referenced patent.

In operation, and referring to FIG. 1, the work string 10 is lowered to a predetermined depth in the wellbore 12, so that the lower end of the tubing section 14 is positioned above the bottom of the wellbore, with the device 26 centering the work string in the wellbore. The tool 16 is in the position of FIG. 3A, i.e., with the sleeve 38 covering the ports 30*b*, and the tool 20 is in its coupled position described above.

A predetermined volume of fluid is then pumped into the work string 10. The fluid can consist of any slurry capable of forming a hardened plug, such as, for example, a combination of cement and sufficient water to form a pumpable slurry. The slurry may also include additives to accelerate the hardening time, to combat or otherwise prevent fluid loss and gas migration, and to resist loss in compressive strength caused by high downhole temperatures. Since the composition of the slurry is conventional, it will not be described in further detail.

The slurry flows through the work string 10 before it discharges through the lower end of the tubing section 14 and fills the lower portion of the wellbore 12. The slurry then rises up to fill the annulus between the wall of the wellbore and the tubing sections 14 and 16.

When the volume of slurry approaches the volume that the formation can withstand, or when the height of the slurry in the wellbore approaches the height of the ports 30*b*, the introduction of the slurry is then terminated, and it is allowed to harden to form a plug. Then, the ball valve 42 (FIG. 3A) is introduced into the work string 10 and is forced through the work string by introducing a pressurized fluid, such as water, cleaning fluid, or drilling fluid, etc. into the work string behind the ball valve. After passing through the tubing sections 22 and 18 and the tool 20, the ball valve 42 enters the upper end portion of the tool 16 and sealingly engages the seat 38*a* of the sleeve 38. The fluid behind the ball valve 42 then creates a pressure acting against the ball valve, which results in an axial force that is transferred to the sleeve 38 which, in turn, exerts a shear force on the shear pins 40. When this force exceeds a predetermined value, the shear pins 40 will fail and allow the sleeve 38, as well as the ball valve 42, to move downwardly in the tool 16 until the lower end of the sleeve 38 engages the shoulder 30*a* as shown in FIG. 3B. During this movement of the sleeve 38 and the ball valve 42, the ports 30 are uncovered, or exposed.

Another predetermined volume of cement slurry is then pumped into the work string 10. The slurry flows through the tubing sections 22 and 18 and the tool 20 but is blocked from passage through the tool 16 by the ball valve 42. The slurry thus discharges through the exposed ports 30*b* of the tool 16 into the annulus between the lower portion of the tool and the wall of the wellbore 12 and above the previous hardened cement plug. The slurry then rises in the annulus between the wall of the wellbore 12 and the outer surfaces of the upper portion of the tool 16, the tubing section 18, and the lower portion of the tool 20. When the volume of slurry approaches the volume that the formation can withstand, or when the height of the slurry in the above annulus wellbore approaches the upper end of the lower body member of the tool 20, the introduction of the slurry into the wellbore is terminated, and the slurry is allowed to harden.

The above-mentioned ball valve associated with the tool 20 is then introduced into the work string 10 and forced through the work string by introducing a pressurized fluid into the work string behind the ball valve. After passing through the tubing section 22, the ball valve enters the upper end portion of the tool 20 and sealingly engages a seat, as described above. When the pressure, and the resulting force on the ball valve, exceed a predetermined value, shear pins associated with the tool 20 will shear, allowing a sleeve to slide which uncouples the lower body member of the tool from the upper body member. This lower body member of the tool 20, along with the tubing sections 14 and 18 and the tool 16, fall to the bottom of the wellbore 12. Then the tubing section 22 and the upper portion of the tool 20 can be pulled from the wellbore.

The above technique thus allows two separate plugs to be formed in the wellbore 12 without having to withdraw the work string 10 from, and reinsert it into, the wellbore. Moreover, the quantity of slurry introduced into the wellbore to form each plug is less than the maximum that the formation can withstand.

Several additions, modifications, and/or variations can be made in the above without departing from the scope of the invention. For example, a quantity of cleaning and/or drilling fluid may be introduced into the work string 10 prior to one or both of the introductions of the cement slurry. Also, a foam wiper ball valve, or dart, can be passed through the work string any time during the above operations to clean the bores of the work string. Further the centering device 26 can be disposed around the tool 16, rather than the tubing section 14. Moreover, a drill pipe dart, or the like, could be used instead of the ball valve 42, or a combination of darts and ball valves could be used. Moreover, spatial references, such as "upper", "lower", "above", "below", "axial" "radial", "angular", etc.

are for the purpose of illustration only and do not limit the specific orientation or location of the structure described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for forming multiple plugs in a wellbore, comprising:

a first tubing section having an upper end and a lower end;

a first tool located below the first tubing section and connected in fluid communication with the lower end of the first tubing section, the first tool comprising:

at least one body member having a bore for permitting a first volume of fluid to pass into the bore and discharge from an end of the bore into the wellbore;

at least one port in the body member that communicates with the bore for permitting a second volume of fluid to pass into the bore and discharge from the at least one port into the wellbore; and means for normally covering the at least one port to permit the first volume of fluid to discharge from the end of the bore into the wellbore, wherein the means is adapted to uncover the at least one port to permit the second volume of fluid to discharge from the at least one port into the wellbore; and a second tool located above the first tool and connected in fluid communication with the upper end of the first tubing section, the second tool comprising:

an upper body member;

a lower body member coupled to the upper body member; and means for decoupling the upper and lower body members to permit the upper body member, and any tubing sections above the upper body member, to be removed from the wellbore.

2. The apparatus of claim 1, wherein at least one of the first volume of fluid and the second volume of fluid is a slurry that hardens after being discharged into the wellbore.

3. The apparatus of claim 1, wherein the first tool extends between the first tubing section and a second tubing section and wherein the first volume of fluid is a slurry that hardens after being discharged into the wellbore below the second tubing section that extends below the first tool.

4. The apparatus of claim 1, wherein a first plug is formed in the wellbore by the first volume of fluid and a second plug that extends in an axially spaced relation to the first plug is formed in the wellbore by the second volume of fluid.

5. The apparatus of claim 1, wherein the second volume of fluid discharges into the wellbore at an elevation in the wellbore that is above the first volume of fluid in the wellbore.

6. The apparatus of claim 1, wherein the second volume of fluid is a slurry that hardens, around the lower body member of the second tool.

7. The apparatus of claim 1, wherein the first tool is connected in fluid communication with and is above a second tubing section and wherein the second tool is connected in fluid communication with and is between the first tubing section and a third tubing section.

8. The apparatus according to claim 1, further comprising:

a first ball configured to interact with the means for normally covering the at least one port; and a second ball configured to interact with the means for decoupling the upper and lower body members.

9. The apparatus according to claim 8, wherein the first ball is smaller than the second ball.

10. A method for forming multiple plugs in a wellbore, comprising:

connecting a first tool in a work string;

introducing a first volume of slurry into the work string so that it flows through the work string and discharges from a lower portion of the work string that is located below the first tool;

terminating the step of introducing the first volume of slurry;

allowing the first volume of slurry to harden;

opening at least one normally-closed port that extends through a wall of the first tool;

introducing a second volume of slurry into the work string so that it flows through the open at least one port and discharges from the at least one port;

terminating the step of introducing the second volume of slurry;

allowing the second volume of slurry to harden;

decoupling an upper portion of the work string that is located above the first tool from the first tool; and removing the upper portion of the work string from the wellbore.

11. The method of claim 10, wherein a continuous bore is formed through the work string and the first tool so that the first volume of slurry normally passes through the bore before discharging into the wellbore.

12. The method of claim 11, wherein the slurry hardens after being discharged into the wellbore so that a first plug is formed in the wellbore by the hardened first volume of slurry, and a second plug is formed in the wellbore by the hardened second volume of slurry.

13. The method of claim 12, wherein the second volume of slurry discharges into the wellbore at an elevation in the wellbore that is above the elevation where the first volume of slurry discharges so that the second plug extends above the first plug.

14. The method of claim 10, wherein the step of opening comprises moving a sleeve in the first tool to uncover the at least one port.

15. The method of claim 14, wherein the at least one port is formed through the at least one body member of the first tool and is normally covered by the sleeve, and wherein the at least one port is uncovered in response to the movement of the sleeve.

16. The method of claim 10, wherein:

the first tool extends between an upper tubing section above the first tool and a lower tubing section below the first tool;

a first portion of the first volume of slurry discharges into the wellbore below the lower tubing section; and the second volume of slurry discharges into an annulus between the wellbore and the first tool.

17. The method of claim 10, wherein the step of removing the upper portion of the work string comprises decoupling an upper portion of a second tool from a lower portion of the second tool to permit the upper portion of the second tool and a portion of the work string that extends above the upper portion of the second tool, to be removed from the wellbore.

18. The method of claim 17, wherein the first volume of slurry hardens around the lower portion of the first tool and the second volume of slurry hardens around the lower portion of the second tool.

19. The method of claim 10, wherein the first volume of slurry is less than a volume of fluid the wellbore can withstand.

20. The method of claim 19, wherein the first tool distributes the first volume of slurry up to about the location of the at least one port.

21. The method of claim 10, wherein the second volume of slurry is less than a volume of fluid the wellbore can withstand.

22. The method of claim 21, wherein the first tool distributes the second volume of slurry to an elevation within the wellbore higher than the elevation of the first tool.

* * * * *